US010486320B2

(12) United States Patent
Molinari

(10) Patent No.: US 10,486,320 B2
(45) Date of Patent: Nov. 26, 2019

(54) DEVICE FOR SUPPORTING RAZOR BLADES

(71) Applicant: Andrea Molinari, Sanremo (IT)

(72) Inventor: Andrea Molinari, Sanremo (IT)

( * ) Notice: Subject to any disclaimer, the term of this patent is extended or adjusted under 35 U.S.C. 154(b) by 0 days.

(21) Appl. No.: 15/109,088

(22) PCT Filed: Dec. 23, 2014

(86) PCT No.: PCT/EP2014/079209
§ 371 (c)(1),
(2) Date: Jun. 29, 2016

(87) PCT Pub. No.: WO2015/101566
PCT Pub. Date: Jul. 9, 2015

(65) Prior Publication Data

US 2016/0325445 A1 Nov. 10, 2016

(30) Foreign Application Priority Data

Jan. 2, 2014 (IT) ..... GE2014A0002

(51) Int. Cl.
*B26B 21/56* (2006.01)
*B26B 21/52* (2006.01)
*B26B 21/14* (2006.01)

(52) U.S. Cl.
CPC ..... *B26B 21/521* (2013.01); *B26B 21/14* (2013.01); *B26B 21/52* (2013.01)

(58) Field of Classification Search
CPC ..... B26B 21/521; B26B 21/14; B26B 21/52
USPC ..... 30/50
See application file for complete search history.

(56) References Cited

U.S. PATENT DOCUMENTS 1,234,834 A * 7/1917 Warren ..... B26B 21/52 30/47
5,092,041 A * 3/1992 Podolsky ..... B26B 21/446 30/34.2
6,880,253 B1 * 4/2005 Gyllerstrom ..... B26B 21/14 30/50
7,093,363 B1 * 8/2006 Kuo ..... B26B 21/40 30/32
8,793,880 B2 * 8/2014 Taub ..... B26B 21/40 30/32
2005/0011072 A1 1/2005 Segrea
2010/0037463 A1 * 2/2010 Maichel ..... B26B 19/3813 30/34.1
2010/0064520 A1 3/2010 Park et al.
(Continued)

FOREIGN PATENT DOCUMENTS

DE 102007050381 A1 4/2009
EP 0203527 A1 12/1986
WO WO2013082815 A1 6/2013

*Primary Examiner* — Omar Flores Sanchez
(74) *Attorney, Agent, or Firm* — Themis Law

(57) ABSTRACT

A device for supporting heads of a razor intended to be mounted on the handle of replaceable head razors, the handle having a coupling end for removably coupling a head. The supporting device includes a case element removably engageable with the coupling end, the case element having surfaces contacting, at least partially, the surface of the coupling end, generating a form-fit connection. The case element has attachment members for the engagement into corresponding attachment seats provided on the head. The present invention further relates to a head for razors and to a razor.

10 Claims, 4 Drawing Sheets

(56) References Cited

U.S. PATENT DOCUMENTS

| | | | | |
|---|---|---|---|---|
| 2010/0299927 | A1* | 12/2010 | Fischer | B26B 19/06 30/34.1 |
| 2011/0308087 | A1 | 12/2011 | Rehbein et al. | |
| 2013/0312272 | A1* | 11/2013 | Wilson | B26B 21/521 30/532 |

* cited by examiner

DEVICE FOR SUPPORTING RAZOR BLADES

The present invention relates to a device for supporting razor heads intended to be mounted on the handle of replaceable head razors, which replaceable head razors comprise a handle, which handle has a coupling end for removably coupling a head.

There are several types of removable head razors which are the subject matter of several patent applications.

A typical example is described in the document EP1009957 that discloses a replaceable head razor comprising a handle part and a head part.

The head part has fastening members cooperating with corresponding fastening elements of the handle part in order to fasten the head to the handle.

There is further provided a movable element for activating/releasing the connection of the head to the handle part.

Another example of a replaceable head razor is described in the document EP 1053837.

According to such documents and to the replaceable head razors known in the prior art, there is always provided an activation mechanism that allows the head to be connected to and released from the handle part.

The mechanism activating the connection of the head generally is composed of members that are supported in a retractile manner inside the handle, whose movement allows the head to be connected or released.

Moreover preferably the connection of the head has to be carried out in such a manner that the head can pivot such to optimally follow the profile of the face being shaved.

Therefore it is clear how such mechanism can be complicated from a structural point of view.

Since such mechanism is the most complicated part of a structurally simple tool, as the razor, it cannot be intended for the head part which is the "disposable" part, but it has to be integrated with the razor handle.

However due to its structural complexity, it has often malfunctions and inefficiencies in the connection, requiring to replace the handle of the razor, generating an undesired cost for the user.

Therefore razors known in the prior art have a main drawback related to the mechanism activating the connection of the heads due to an undesired increase of costs, since it requires to occasionally replace the handle due to malfunctions or it has a construction that is so complicated to require an excessive expense both for the company producing it and for the user.

Therefore there is an unsatisfied need in razors known in the prior art to provide a replaceable head razor that is efficient, inexpensive and that allows the drawbacks of the prior art known systems to be overcome.

The present invention achieves the above objects by providing a device for supporting razor heads composed of a case element removably engageable with the coupling end.

The case element has surfaces contacting, at least partially, the surface of the coupling end, generating a form-fit connection.

Moreover the case element has attachment members for the engagement into corresponding attachment seats provided on the head.

Therefore the case element mutually engages with the end part of the razor by a form-fit connection, that consequently does not require any complicated mechanism.

Moreover in the case the contact surfaces engage a standard contact part of the razor handle, such as a part of the rod, the described arrangement of the case element allows the head to be fastened regardless of the type of coupling end of the handle.

The form-fit connection can be obtained in any manner known in the prior art.

It is specified that, as it will clearly result in some embodiments described below, preferably the case element is composed of a box-like element, comprising two half-cases hinged with each other, such that the case element is openable and/or closable and such that in the closing condition the box-like body completely surrounds the coupling end.

According to a preferred embodiment, the case element is composed of two half-cases hinged with each other.

The two half-cases pass from an opening condition, where they are moved away from each other, to a closing condition, where they are one near the other, such that in the closing condition the case element is fastened to the coupling end of the handle.

Obviously such arrangement facilitates the proper positioning of the case element and it facilitates also the removal thereof.

Advantageously the two half-cases are hinged with each other at the attachment members.

As it will be clearly shown in the figures annexed to the present patent application, such embodiment optimizes the connection of the case element to the coupling end of the razor, facilitating the positioning of the contact surfaces.

In order to improve the engagement of the case element with the coupling end it is possible to provide abutment members, that, with the case element in the mounted condition, abut against at least a part of the coupling end of the handle.

Such abutment members help in making the connection of the case element to the coupling end more stable, enhancing the action of said contact surfaces.

According to a possible embodiment the abutment members can comprise a through hole obtained on the case element.

As it will be described below the through hole for example can abut against projecting parts of the coupling end.

Advantageously there are provided means for removably fastening the two half-cases in the closing condition.

In order to obtain the advantageous aspects of the razors known in the prior art, in combination with the characteristics just described, the device of the present invention can provide elements intended to allow a relative movement between the head and the case element.

For example it is possible to provide such elements to allow the head to pivot with respect to the case element, according to the arrangements known in the prior art.

It is possible to provide such elements to be provided on the head or on the case element, and for example it is possible to provide the attachment members to be supported by the case element by means of such elements intended to allow a relative movement between the head and the case element.

According to a further embodiment it is possible to provide the attachment members to be made as one piece with the case element.

Obviously also in the case when the attachment members are made as one piece with the case element, it is possible to provide elements intended to allow a relative movement between the head and the case element, such as described before.

In the light of the characteristics and advantageous aspects described up to now, the present invention relates also to a razor head intended to be mounted on the handle of replaceable head razors, which replaceable head razors comprise a handle, which handle has an end removably coupling with replaceable heads.

The head comprises a case element removably engageable with the coupling end.

Moreover the case element has surfaces contacting, at least partially, the surface of the coupling end, generating a form-fit connection.

The case element further has attachment members for the engagement into corresponding attachment seats provided on said head.

The head of the present invention has one or more of the characteristics, as an alternative or in combination, described above for said device supporting razor heads.

Finally the present invention relates also to a replaceable head razor comprising a head, coupled to the razor handle by a coupling end.

The razor comprises a case element removably engageable with the coupling end.

The case element provides surfaces contacting, at least partially, the surface of the coupling end, generating a form-fit connection.

Moreover the case element has attachment members for the engagement into corresponding attachment seats provided on the head.

The razor of the present invention has one or more of the characteristics, as an alternative or in combination, described above for said device supporting razor heads.

These and other characteristics and advantages of the present invention will be more clear from the following description of some embodiments shown in the annexed drawings wherein:

FIGS. 1*a* to 1*c* are a possible variant embodiment of the device supporting razor heads of the present invention;

FIGS. 2*a* to 2*d* are a preferred embodiment of the device of the present invention;

It is specified that the shown embodiments have to be intended merely for illustrative purposes, in order to better understand the advantages and the characteristics of the present invention.

Therefore such embodiments have not to be intended as a limitation of the inventive concept of the present invention, which is related to the production of a device for razor heads simple to be fitted on the handle of the razor and that guarantees an efficacious and long-lasting operation.

Moreover due to expository purposes, the characteristics and the advantages of the present invention are shown and described for a device supporting razor heads, but such characteristics have to be considered also relating to the head and the razor which are the subject matter of the present invention too.

With particular reference to FIGS. 1*a* to 4, the device for supporting razor heads 12 is mounted on the handle 11 of the razor 1 with replaceable heads 12.

Figure 1A:
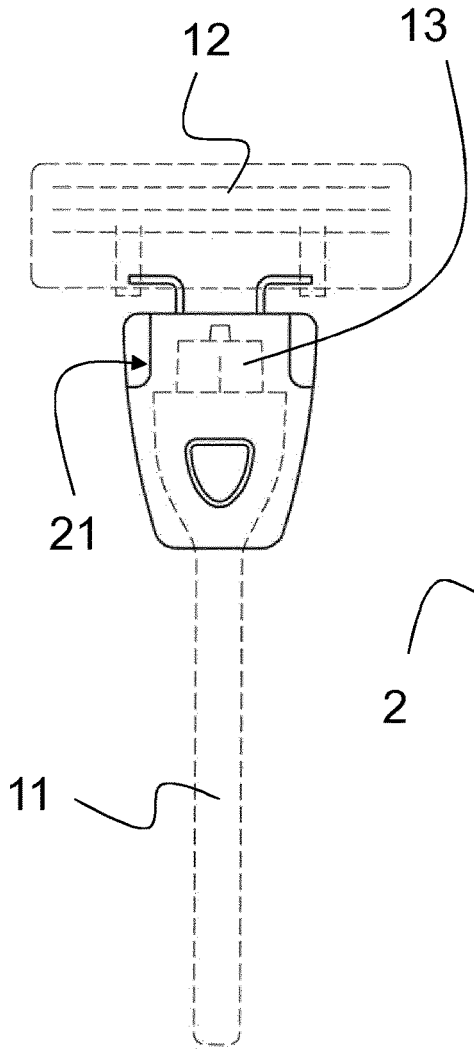
Figure 1B:
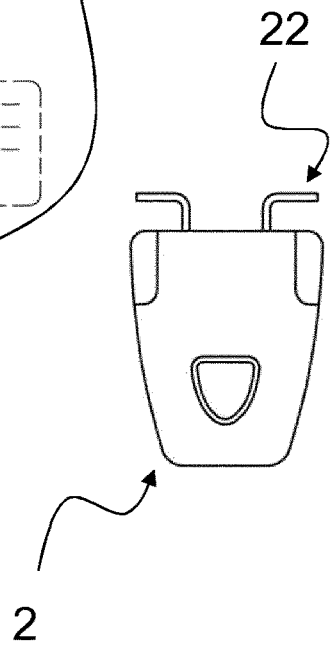
Figure 1C:
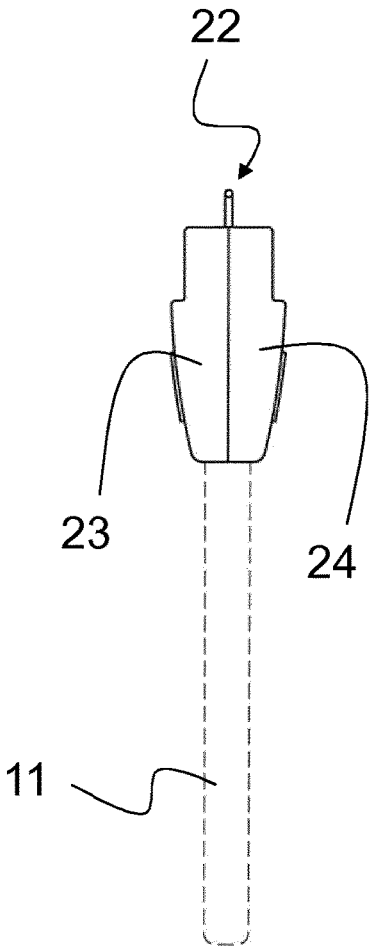
Figure 2A:
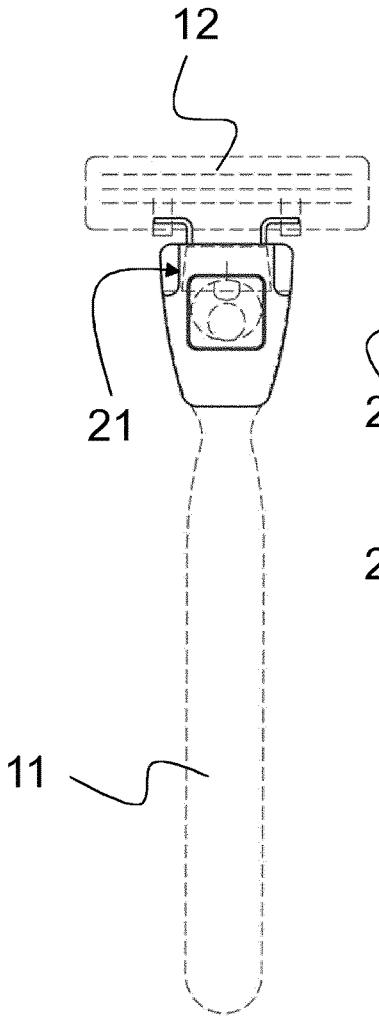
Figure 2B:
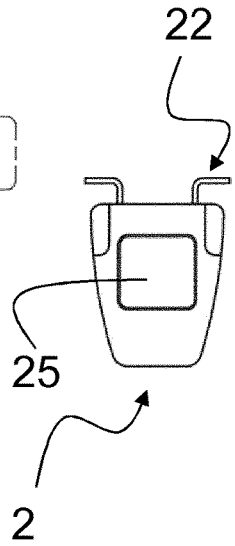
Figure 2C:
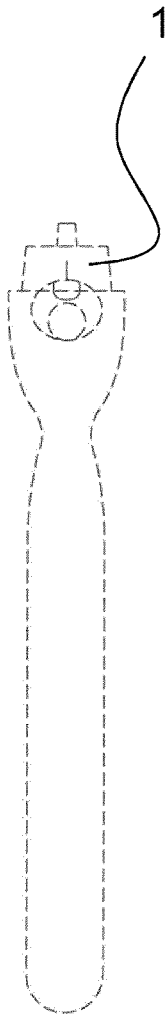

Particularly the handle 11 has a coupling end 13, FIG. 2*c*, the head 12 generally being connected thereto.

According to the invention the head supporting device is composed of a case element 2 removably engageable with the coupling end 13.

The case element 2 overlaps at least partially the coupling end 13 and it engages therewith by the provision of surfaces 21 contacting the surface of the coupling end 13, generating a form-fit connection.

Such as shown in the figures, preferably the profile of the case element 2 follows precisely the profile of the coupling end 13, such to reduce the dimensions and the encumbrance of the case element and such to guarantee a more stable connection to the razor 1.

Figure 3:
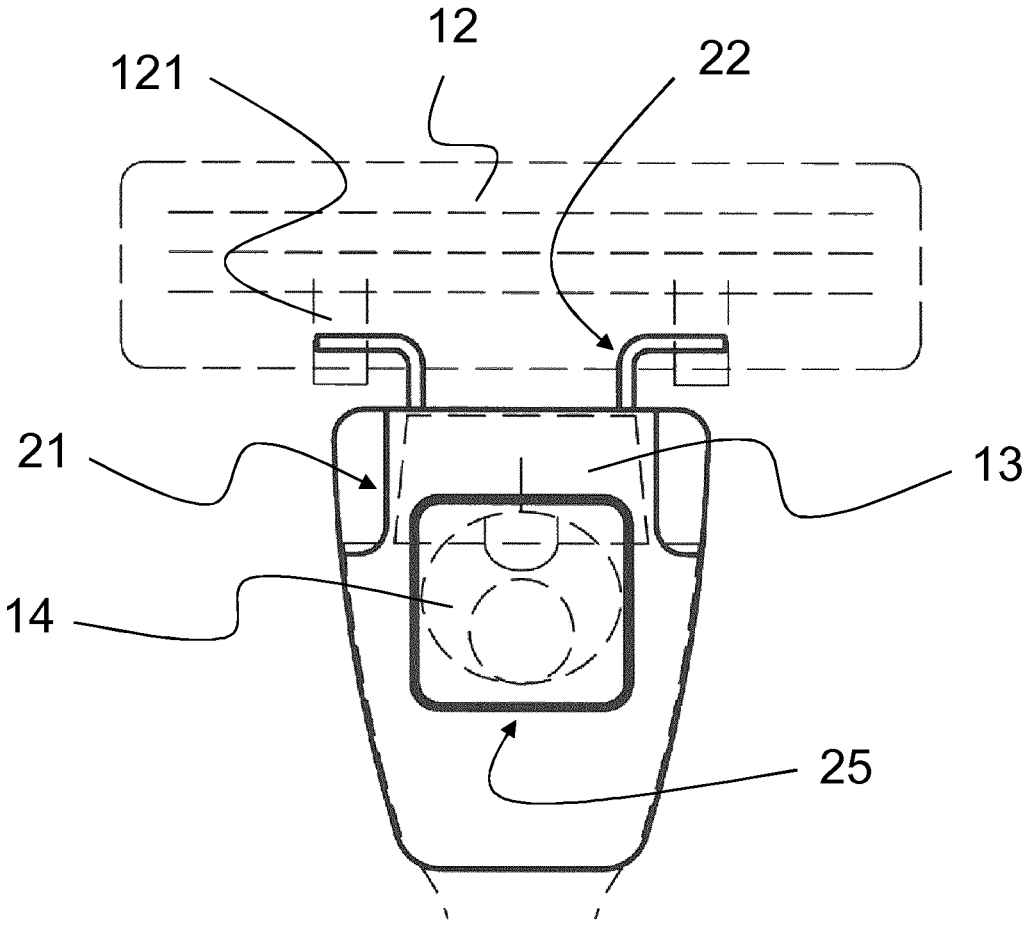
FIG. 3 is a detail of FIG. 2*a*.

Such arrangement is clearly shown in FIG. 3, where the contact surfaces 21 exactly follow the shape of the coupling end 13, whose lines are broken lines.

The case element 2 provides attachment members for the engagement into corresponding attachment seats 121 provided on the head 12.

Such attachment members 22 can be fixed or movable such to facilitate the insertion thereof into attachment seats 121, according to any manner known in the prior art.

The case element 2 can be made in any manner known in the prior art.

For example it is possible to provide it to be composed of a kind of "cap" which is inserted on the coupling end 13 by forcing it.

The case element 2 has a predetermined intrinsic elasticity if it is made of plastic material and it can be forced on the coupling end 13 such to be firmly engaged therewith by a temporary deformation of the contact surfaces 21.

As an alternative according to a preferred embodiment, the case element is composed of a box-like body.

The box-like body comprises two half-cases 23 and 24 hinged with each other, such that the case element is openable and/or closable and such that in the closing condition the box-like body completely surrounds the coupling end 13.

Such as shown in the figures, the case element is composed of a box-like body that is openable and closable according to at least one partition plane, and by this opening and closing action, it clamps the coupling end 13 therein.

In the variant embodiment shown in the figures, the box-like body does not close therein only the coupling end 13, but it surrounds also a part of the handle 11, particularly the end part which is wider than the remaining part of the handle 11.

Therefore the case is a box-like body that is openable and closable and it has an inner housing area for housing the end part of the handle 11, which is wider than an outlet aperture of the box-like body, placed on the side opposite to the head 12 and that surrounds the side surface of the handle 11.

Particularly the case element 2 is composed of two half-cases 23, 24 hinged with each other, such that the two half-cases 23, 24 pass from an opening condition, where the two half-cases 23, 24 are moved away from each other, to a closing condition, where the two half-cases 23, 24 are moved near one to the other, such that in the closing condition the case element 2 is fastened to the coupling end 13 of the handle 11.

Figure 4:
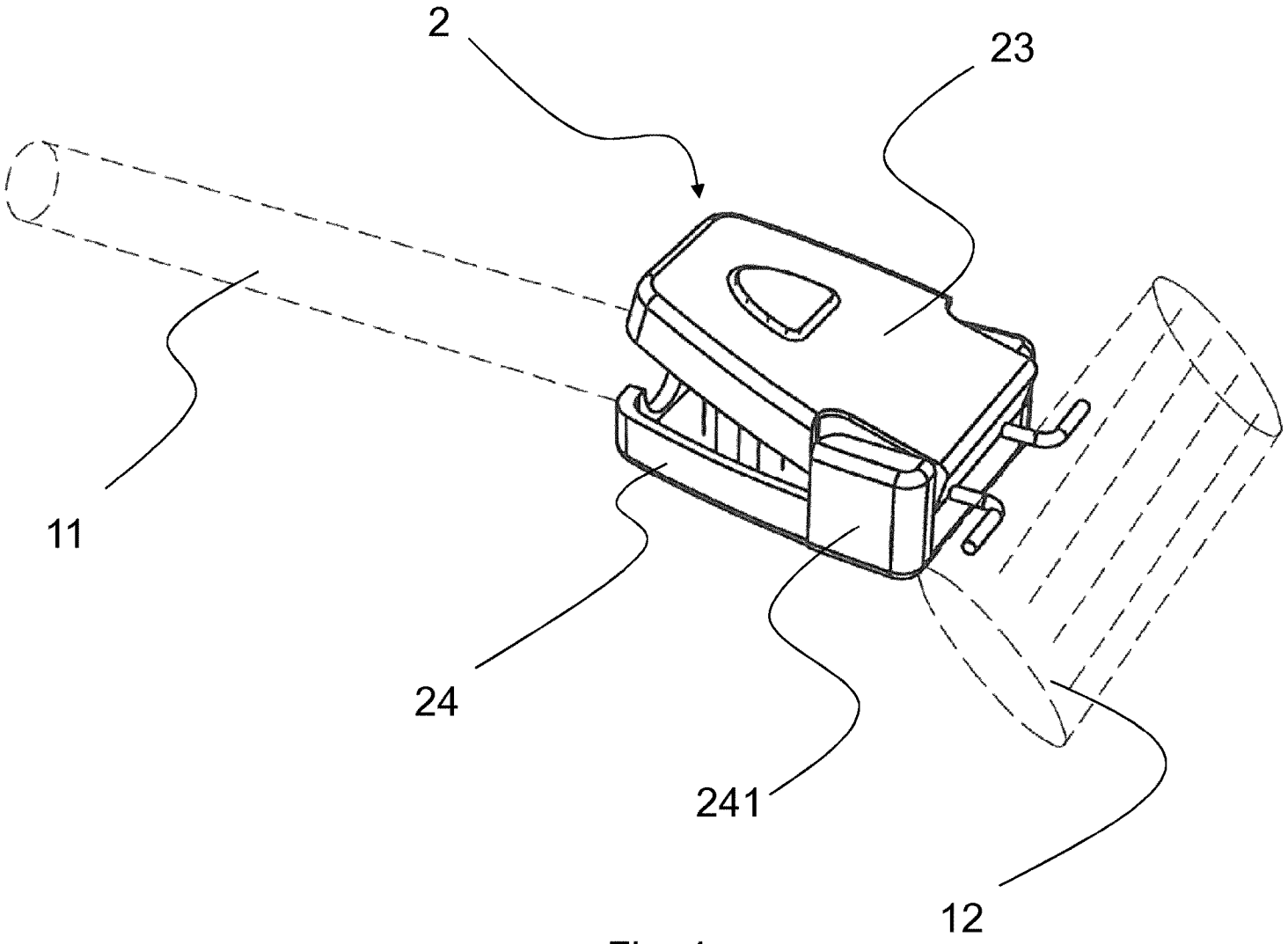
FIG. 4 is a perspective view of a possible embodiment of the device of the present invention.

FIG. 4 shows the two half-cases 23 and 24 in the opening condition.

The two half-cases 23 and 24 are placed in the opening condition, they are overlapped to the coupling end 13, then they are placed in the closing condition, such that the contact surfaces 21 engage the surfaces of the coupling end 13.

Preferably the two half-cases 23 and 24 are hinged with each other at the attachment members 22, such that the half-case can pivot about an axis A in order to move near/away from the half-case 24.

According to the embodiment of FIG. 4, the half-case 24 has two elements 241 extending in the direction of the half-case 23, which on the contrary has a profile following the one of the coupling end 13.

The two elements 241 are preferably solid and the space for housing the elements acting as the hinge is obtained in the thickness thereof.

Thus in the closed condition the two half-cases 23 and 24 form a housing compartment housing the coupling end 13, such that there is no relative movement between the case element 2 and the coupling end 13.

According to a preferred variant embodiment, the case element 2 has abutment members 25, that, with the case element 2 in the assembled condition, abut against at least a part of the coupling end 13 of the handle 11.

Figure 2D:
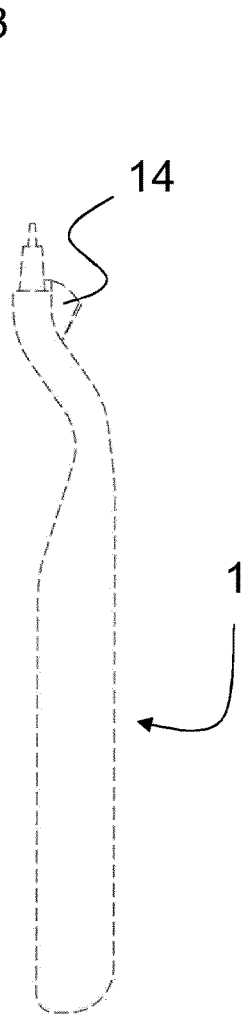

With a particular reference to FIGS. 2*b* and 2*d*, the abutment members comprise a through hole 25 obtained on the case element 2.

Particularly the through hole 25 is obtained in the thickness of the walls of the half-case 23 and, with the two half-cases 23 and 24 in the closed condition, at least one of the sides of the hole 25 abuts against the projecting element 14 of the handle 11.

Particularly the lower side of the hole 25 abuts against the lower portion of the projecting element 14.

According to a possible embodiment not shown, the two half-cases 23 and 24 have means for removably fastening them in the closing condition.

The fastening means can be made in any manner known in the prior art allowing one half-case to be fastened in position on the other half-case.

For example such fastening means can be composed of integral tabs extending from one of the two half-cases 23, 24 in the direction of the other one and engaging into corresponding seats provided on the walls thereof.

A pressure of the fingers will be sufficient for releasing the tabs from their seats and for allowing the half-case 23 to move away from the half-case 24 such to put them in the opening condition.

Moreover it is possible to provide to obtain a relative movement between the head 12 and the case element 2, such that the head 12 can pivot about an axis in the direction shown by arrow B.

Several embodiments are possible for obtaining the result shown.

For example it is possible for the attachment members 22 to be supported by the case element 2 by elements intended to allow a relative movement between the head 12 and the case element 2.

As an alternative the attachment members 22 can be made as one piece with the case element 2 and can be housed in the seats 121 such that the head is pivotably supported by the members themselves.

The invention claimed is:

1. A device for supporting a head of a razor (1) adapted to be mounted on a handle (11) of a replaceable head razor, wherein the replaceable head razor comprises the handle (11), wherein the handle (11) has a coupling end (13) for removably coupling the head (12), wherein said supporting device comprises a case element (2) removably engageable with said coupling end (13), wherein said case element (2) has surfaces contacting, at least partially, a surface of said coupling end (13), thereby generating a form-fit connection, wherein said case element (2) has attachment members (22) for engagement into corresponding attachment seats provided on said head (12), and wherein said case element (2) comprises a box-shaped body having two half-cases (23, 24) hinged with each other, such that said case element is openable and/or closable and such that, in a closing condition, said box-shaped body completely surrounds said coupling end (13).

2. A device for supporting a head of a razor (1) adapted to be mounted on a handle (11) of a replaceable head razor, wherein the replaceable head razor comprises the handle (11), wherein the handle (11) has a coupling end (13) for removably coupling the head (12), wherein said supporting device comprises a case element (2) removably engageable with said coupling end (13), wherein said case element (2) has surfaces contacting, at least partially, a surface of said coupling end (13), thereby generating a form-fit connection, wherein said case element (2) has attachment members (22) for engagement into corresponding attachment seats provided on said head (12), and wherein said case element (2) comprises two half-cases (23, 24) hinged with each other, such that said two half-cases (23, 24) pass from an opening condition, wherein said two half-cases (23, 24) are moved away from each other, to a closing condition, wherein said two half-cases (23, 24) are moved one next to the other, such that in the closing condition said case element (2) is fastened to said coupling end (3) of said handle (11).

3. The device according to claim 2, wherein said two half-cases (23, 24) are hinged with each other at said attachment members.

4. The device according to claim 1, wherein said case element (2) has abutment members, wherein said abutment members, with said case element (2) in a mounted condition, abut against at least a part of said coupling end (13) of said handle (11).

5. The device according to claim 4, wherein said abutment members comprise a through hole defined in said case element (2).

6. The device according to claim 1, said half-cases (23, 24) have members that removably fasten said two half-cases (23, 24) in the closing condition.

7. The device according to claim 1, wherein said attachment members (22) are supported by said case element (2) by elements adapted to allow a relative movement between the head (12) and the case element (2).

8. The device according to claim 1, wherein said attachment members (22) are made as one piece with said case element (2).

9. A head (12) of a razor (1) adapted to be mounted on a handle (11) of a replaceable head razor, wherein the replaceable head razor comprises a handle (11), which (11) has a coupling end (13) for removably coupling a replaceable head, wherein said head (12) comprises a case element (2) removably engageable with said coupling end (13), wherein said case element (2) has surfaces contacting, at least partially, a surface of said coupling end (13), thereby generating a form-fit connection, wherein said case element (2) has attachment members for engagement into corresponding attachment seats provided on said head (12), wherein said case element (2) comprises two half-cases (23, 24) hinged with each other, such that said two half-cases (23, 24) pass from an opening condition, wherein said two half-cases (23, 24) are moved away from each other, to a closing condition, wherein said two half-cases (23, 24) are moved one next to the other, such that in the closing condition said case element (2) is fastened to said coupling end (3) of said handle (11).

10. A razor (1) comprising:

a replaceable head (12); and a handle (11) connectable to the replaceable head by a coupling end (13), wherein said razor (1) comprises a case element (2) removably engageable with said coupling end (13), wherein said case element (2) has surfaces contacting, at least partially, a surface of said coupling end (13), thereby generating a form-fit connection, wherein said case element (2) has attachment members for engagement into corresponding attachment seats provided on said head (12), wherein said case element (2) comprises two half-cases (23, 24) hinged with each other, such that said two half-cases (23, 24) pass from an opening condition, wherein said two half-cases (23, 24) are moved away from each other, to a closing condition, wherein said two half-cases (23, 24) are moved one next to the other, such that in the closing condition said case element (2) is fastened to said coupling end (3) of said handle (11).

* * * * *